United States Patent [19]

Matusita et al.

[11] Patent Number: 4,982,897

[45] Date of Patent: Jan. 8, 1991

[54] SPRAYING METHOD AND APPARATUS EMPLOYED THEREFOR

[75] Inventors: Yoshio Matusita; Takeshi Mochizuki; Ikuya Shiraishi, all of Kanagawa, Japan

[73] Assignee: Iwata Air Compressor Mfg. Co., Ltd., Tokyo, Japan

[21] Appl. No.: 897,028

[22] Filed: Aug. 15, 1986

[51] Int. Cl.[5] ..... B05B 7/12

[52] U.S. Cl. ..... 239/71; 118/684; 239/456; 239/583

[58] Field of Search ..... 239/67, 71, 583, 569, 239/456, 451; 118/684, 300; 251/129.11, 250

[56] References Cited

U.S. PATENT DOCUMENTS

| | | | |
|---|---|---|---|
| 2,403,751 | 3/1945 | Palmer | 251/250 X |
| 3,235,186 | 2/1966 | Boyce | 239/415 |
| 3,252,441 | 5/1966 | Hargreaves | 118/684 |
| 3,561,398 | 2/1971 | Rose | 118/707 X |
| 3,605,683 | 9/1971 | Wiggins | 118/685 |
| 3,724,415 | 4/1973 | Knight | 118/668 |
| 3,933,312 | 1/1976 | Fries | 239/413 |
| 4,154,403 | 5/1979 | Forrester | 239/73 |
| 4,159,082 | 6/1979 | Luderer | 239/412 |
| 4,162,042 | 7/1979 | Mommsen | 239/526 |
| 4,220,115 | 9/1980 | Grossman et al. | 118/684 |
| 4,334,495 | 6/1982 | Derkacs | 118/669 |
| 4,357,900 | 11/1982 | Buschor | 118/684 X |
| 4,501,223 | 2/1985 | Matsuno | 118/668 |
| 4,520,516 | 6/1985 | Parsons | 367/96 X |
| 4,545,363 | 10/1985 | Barchechat et al. | 251/129.11 X |
| 4,572,253 | 2/1986 | Farmer | 141/95 |
| 4,613,528 | 9/1986 | Muellor | 118/668 X |
| 4,660,771 | 4/1987 | Chabert | 239/69 |

FOREIGN PATENT DOCUMENTS

| | | | |
|---|---|---|---|
| 61342 | 9/1982 | European Pat. Off. . | |
| 74856 | of 1893 | Fed. Rep. of Germany | 239/456 |
| 1111545 | 7/1961 | Fed. Rep. of Germany | 239/583 |
| 3236647 | 4/1984 | Fed. Rep. of Germany . | |
| 2517567 | 6/1983 | France . | |
| 58-17864 | 2/1983 | Japan . | |
| 58-88064 | 5/1983 | Japan . | |

*Primary Examiner*—Andres Kashnikow

*Attorney, Agent, or Firm*—Wenderoth, Lind & Ponack

[57] ABSTRACT

A spraying method wherein the distance between a spray apparatus and an article is measured by a distance measuring means provided on the spray apparatus, and a spraying condition in which a substance is sprayed is varied in accordance with the measured distance. Also disclosed is a spray apparatus which is suitable for carrying out the above-described method. The apparatus has a supply passage for a substance which is to be sprayed, a nozzle for jetting out the spray substance, and a control valve means provided within the supply passage and adapted to control the flow rate of the spray substance flowing out through the nozzle. A distance measuring means is provided integral with the spray apparatus in one unit, the means being adapted to measure the distance between the spray apparatus and an article and output a signal corresponding to the measured distance. The degree of opening of the control valve means is determined on the basis of the signal output from the distance measuring means.

6 Claims, 2 Drawing Sheets

SPRAYING METHOD AND APPARATUS EMPLOYED THEREFOR

BACKGROUND OF THE INVENTION

1. Field of the Invention

The present invention relates to spraying such as painting wherein a substance to be sprayed is dispersively supplied toward an article which represents the object to be sprayed with that substance.

2. Description of the Related Art

It is known in spraying techniques that the distance between a spray apparatus and an object to be sprayed (said distance being hereinafter referred to as "spray distance") is an important factor to be taken account of if spraying is to be undertaken effectively. In painting, for example, a uniform spray pattern and a preferable coating thickness can be obtained when the spray distance is coincident with a predetermined value which is determined by the spraying conditions of each individual spray apparatus. The fact that the spray distance has a given preferable value for each individual spray apparatus applies not only to cases where the substance to be sprayed is a liquid but also to cases where the spray substance is a finely divided solid as in the case of power painting. In addition, the above-described fact also applies to cases where articles are subjected to spraying when being treated with various kinds of chemical agents, water, adhesives or the like.

There are known methods of maintaining the spray distance at an optimal value at all times. In one type of such conventional methods, the distance from a spray apparatus to an article is detected, and the spray apparatus is moved on the basis of the detected distance so that the spray distance is maintained at a constant value (e.g., the one mentioned in the specification of Japanese Patent Public Disclosure No. 17864/1983 published on Feb. 2, 1983). In another type of such prior art methods, the configuration of an article is stored in a memory in advance, and a spray apparatus is moved on the basis of the stored data so that the spray distance is maintained at a constant value (e.g., the one mentioned in the specification of Japanese Patent Public Disclosure No. 88064/1983 publicly disclosed on May 26, 1983). These prior art spraying methods, however, require a mechanism for automatically moving the spray apparatus in the direction in which the distance to the article is varied, resulting in an increase in the size of the apparatus as a whole, and it is impossible to apply these methods to portable spraying apparatuses which are so designed as to be handheld in used.

SUMMARY OF THE INVENTION

In view of the above-described circumstances, it is a primary object of the present invention to provide a spraying method which enables an optimal spraying condition to be automatically obtained without the need to provide a mechanism for moving a spray apparatus.

It is another object of the present invention to provide an apparatus which is suitable for attaining the above-described spraying method.

To these ends, according to one aspect of the present invention, there is provided a method wherein the distance between a spray apparatus and an article is measured by a distance measuring means provided on the apparatus, and the spraying condition in which a substance is sprayed is automatically changed in accordance with the measured distance.

According to another aspect of the present invention, there is provided a method wherein the distance between a spray apparatus and an article is measured by a distance measuring means provided on the apparatus, and spraying of a substance is automatically started when the measured distance is within a predetermined range.

According to still another aspect of the present invention, there is provided a spray apparatus which has a distance measuring means provided integral therewith in one unit, the means being adapted to measured the distance between the spray apparatus and an article and output a signal corresponding to the measured distance so that the degree of opening of a control valve means for controlling the flow rate of a spray substance flowing out through a nozzle of the spray apparatus is determined in accordance with the output of the distance measuring means.

According to a further aspect of the present invention, there is provided a spray apparatus of the type which has a spray substance control valve means disposed in a spray substance supply passage and adapted to control the flow rate of a spray substance flowing out through a nozzle, and an air control valve means disposed in a pressurized air supply passage and adapted to control the flow rate of air jetted out from an air nozzle, and in which the spray substance is broken up into a mist by virtue of the air blown out through the air nozzle, wherein the degree of opening of at least one of the spray substance control valve means and the air control valve means is determined in accordance with the output of the above-described distance measuring means.

According to a still further aspect of the present invention, there is provided a spray apparatus which has a distance measuring means provided integral therewith in one unit, the means being adapted to measure the distance between the apparatus and an article and generate an output when the measured distance is within a predetermined range, so that a control valve means for controlling the flow rate of a spray substance flowing out through a nozzle of the spray apparatus is opened in response to the output from the distance measuring means so as to commence spraying.

According to a still further aspect of the present invention, there is provided a spray apparatus which has: a valve member for controlling the flow rate of a fluid which is to be jetted out, such as a spray substance or air; a means adapted to press the valve member toward a valve closing position; a solenoid which acts such as to move the valve member toward a valve opening position; a stopper which determines a valve opening position of the valve member; and a servomotor which is connected to the stopper in such a manner that the stopper is displaced in the direction of movement of the valve member, wherein the servomotor is activated in response to a command signal output from a control means.

According to a still further aspect of the present invention, there is provided a spray apparatus which has a servomotor adapted to receive a command signal delivered from a control means and determine an operating position thereof, so that a valve member which controls the flow rate of a fluid to be jetted out, such as a spray substance or air, is moved through a transmission means which is activated in accordance with the operating position of the servomotor.

BRIEF DESCRIPTION OF THE DRAWINGS

The above and other objects, features and advantages of the present invention will become more apparent from the following description of the preferred embodiments thereof, taken in conjunction with the accompanying drawings, in which.

DESCRIPTION OF THE PREFERRED EMBODIMENTS

The present invention will be described hereinunder in detail with reference to the accompanying drawings.

Figure 1:
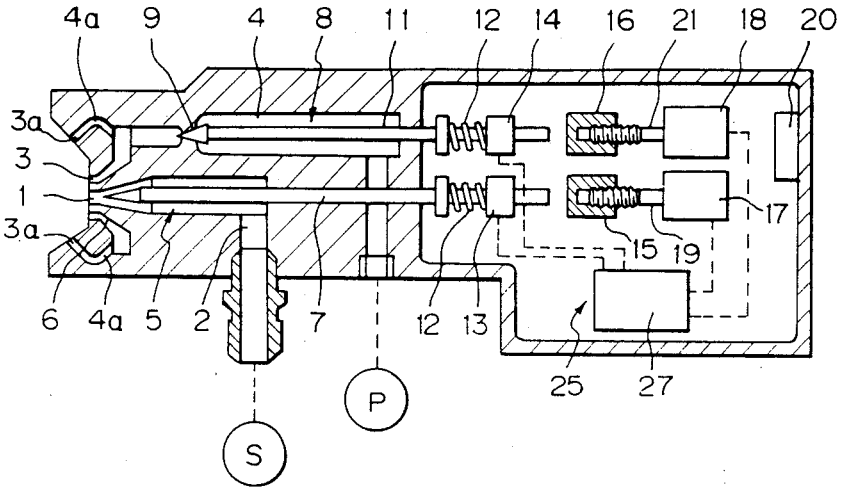
FIG. 1 is a vertical sectional view of a spray apparatus in accordance with one embodiment of the present invention.
Figure 2:
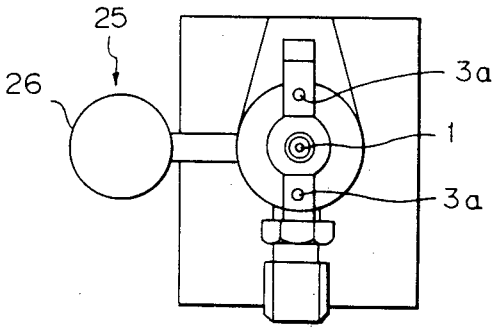
FIG. 2 is an end view of the apparatus shown in FIG. 1.

Referring first to FIG. 1, which is a vertical sectional view of a paint spray apparatus in accordance with one embodiment of the present invention, the apparatus has a paint nozzle 1 and a paint supply passage 2 which is communicated with the nozzle 1. The supply passage 2 is communicated with a paint supply source S. An air nozzle 3 is formed around the paint nozzle 1, and a pressurized air supply passage 4 is formed such as to be communicated with the air nozzle 3. An air compressor P is connected to the air supply passage 4. Spray pattern adjusting air passages 4*a* are branched off from the air supply passage 4 in such a manner that the air passages 4*a* extend to spray pattern adjusting air nozzles 3*a*. The spray pattern can be varied in accordance with the pressure of the air jetted out from these air nozzles 3*a*. A flow rate control valve means 5 for controlling the flow rate of paint is provided in the paint supply passage 2. The control valve means 5 has a valve seat 6 formed in close proximity to the paint nozzle 1, and a valve member 7 provided in such a manner as to be movable toward and away from the valve seat 6. Similarly, a flow rate control valve means 8 for controlling the flow rate of air is provided in the air supply passage 4. This control valve means 8 has a valve seat 9 and a valve member 11. Each of the valve members 7 and 11 is pressed toward its valve closing position by means of spring 12.

The valve members 7 and 11 are respectively combined with solenoids 13 and 14 in such a manner that, when the solenoids 13 and 14 are energized, the respective valve members 7 and 11 are displaced in the valve opening direction. The positions of the valve members 7 and 11 at the time when the solenoids 13 and 14 are energized are determined by stoppers 15 and 16, respectively. The stoppers 15 and 16 are in thread engagement with respect to thread portions respectively provided on output shafts 19 and 21 of servomotors 17 and 18, and are allowed to move in the longitudinal directions of the respective output shafts 19 and 21 but prevented from rotating by any desired means (not shown). Accordingly, the positions of the stoppers 15 and 16 are determined in the longitudinal directions of the respective output shafts 19 and 21 in accordance with the rotational positions of the output shafts 19 and 21.

The spray apparatus has a distance measuring means 25 provided integral therewith in one unit. Various types of means are known which are adapted to detect the distance to an object using ultrasonic waves, light, radio waves, etc. and to generate an electrical output corresponding to the detected distance. Although any type of known distance measuring means may be used in the present invention, a means which utilizes an ultrasonic wave is employed in this embodiment. The distance measuring means 25 comprises a detecting unit 26 which transmits and receives an ultrasonic wave, and an arithmetic output circuit 27 which generates outputs, which are respectively applied to the solenoids 13, 14 and the servomotors 17, 18, on the basis of distance data obtained by the detecting unit 26. The detecting unit 26 is preferably positioned on the same level as the paint nozzle 1. The electric power is supplied to the distance measuring means 25, the solenoids 13, 14 and the servomotors 17, 18 from a battery 20. The power may, however, be supplied from an external power supply in place of the battery 20.

The paint spraying condition capable of providing an optimal coating, that is, either one or both of the flow rates of paint and air which are respectively determined by the positions of the valve members 7 and 11, varies in accordance with the distance between the spray apparatus and the article to be sprayed. Conversely, it is possible to maintain a content or uniform coating within a predetermined spray distance range by varying the paint spraying condition in accordance with the change in the spray distance. When the paint spraying condition is fixed, there is a spray distance range within which an acceptable coating can be formed, corresponding to this fixed spraying condition. The relationship between such spray distance and the paint spraying condition can readily be obtained for each individual spray apparatus by carrying out experiments. The arithmetic output circuit 27 is arranged such as to store data concerning the relationship between the above-described spray distance and the paint spraying condition and generate outputs for determining the respective rotational positions of the servomotors 17 and 18 so that the valve members 7 and 11 are opened in accordance with the distance data obtained by the detecting unit 26 and on the basis of the stored data concerning said relationship. In this embodiment, the arithmetic output circuit 27 is arranged such as to generate an output for energizing the solenoids 13 and 14 only when the distance between the spray apparatus and an article is within a range within which a desired coating can be obtained by the control of the respective positions of the valve members 7 and 11, whereby spraying of paint can automatically be stopped when the spray distance is beyond the above-described range. However, when it is not necessary to provide such function, the arrangement may be such that the solenoids 13 and 14 are energized when a starting switch (not shown) is turned on, and these solenoids may serve simply as means used by an operator to start and stop a painting operation.

In actual use of the above-described embodiment, the operator directs the spray apparatus toward an object and turns on the starting switch (not shown). In consequence, the distance measuring means 25 is activated to continuously measure the distance from the article, and when this distance is within a predetermined range, the solenoids 13 and 14 are energized to start spraying. Immediately before or at the same time as the starting of spraying, the servomotors 17 and 18 are rotated to move the respective stoppers 15 and 16, thus causing each of the valve members 7 and 11 to be set at a position most suitable for a particular spray distance. It should be noted that the selection of a spraying condition by adjusting the positions of valve members can also be accomplished by varying the flow rate of either paint or air alone.

It is possible to modify the spray apparatus shown in FIG. 1 so that it effects spraying only when the distance from an article is within a desired range, without effecting any variation in the spraying condition in relation to the spray distance. In this case, the stoppers 15 and 16 may be made immovable, or may be adapted to be movable as in the embodiment shown in FIG. 1 so that they are moved as desired independently of the measurement of distance. For example, the control means may be adapted to store data concerning the kinds of paint and spraying conditions and programmed so as to output a command signal for giving a desired position to each stopper on the basis of the stored data. Alternatively, the arrangement may be such that the operator designates the position of each stopper through a dial means, and the set position of the dial means is converted into an electrical signal which is to be delivered to the corresponding servomotor, thereby allowing the valve opening to be readily set. The stoppers may be arranged so that the operator can move them by hand.

In addition, the spray apparatus shown in FIG. 1 may also be used as an apparatus which effects only the ON-OFF control of spraying irrespective of the distance from an article.

Figure 3:
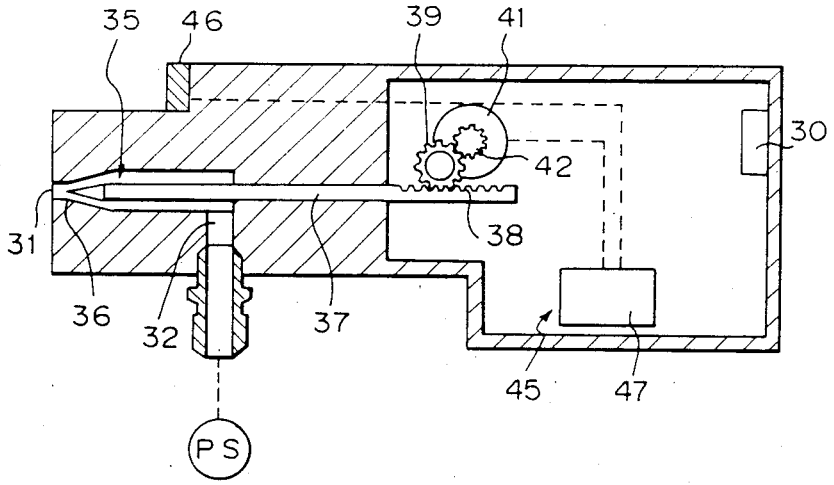
FIG. 3 is a vertical sectional view of a spray apparatus in accordance with another embodiment of the present invention.

Referring next to FIG. 3, which is a vertical sectional view of a paint spray apparatus in accordance with another embodiment of the present invention, the spray apparatus has a paint nozzle 31 and a paint supply passage 32 which is communicated with the nozzle 31. The paint supply passage 32 is communicated with a pressurized paint supply source PS. The pressurized paint is broken up into a mist by the effect of the pressure of the paint when it comes out of the nozzle 31. Accordingly, it is unnecessary, in this embodiment, to supply pressurized air. A control valve means 35 for controlling the flow rate of paint is provided within the supply passage 32. The control valve means 35 has a valve seat 36 formed in close proximity to the nozzle 31, and a valve members 37 adapted to be movable toward and away from the valve seat 36. A rack 38 is formed on the valve member 37, and a pinion 39 is meshed with the rack 38. The pinion 39 is driven by a gear 42 which is secured to the output shaft of a servomotor 41. The spray apparatus has a distance measuring means 45 provided integral therewith in one unit. The means 45 comprises a detecting unit 46 adapted to transmit and receive an ultrasonic wave, and an arithmetic output circuit 47 adapted to generate an output, which allows the valve member 37 to be set at a desired position, on the basis of the distance data obtained by the detecting unit 46. The arithmetic output circuit 47 is further arranged such that, when a starting switch (not shown) is off, the circuit 47 gives an output to the servomotor 41 so that the valve member 37 is automatically returned to its valve closing position. A battery 30 is employed to supply power to the distance measuring means 45 and the servomotor 41.

In actual use of the embodiment shown in FIG. 3, when the operator directs the spray apparatus toward and object and turns on the starting switch, the distance measuring means 45 is activated to continuously measure the distance from the object, and the servomotor 41 is thereby activated to move the valve member 37 to a position at which an optimal paint spraying condition is obtained in accordance with the spray distance detected by the distance measuring means 45.

The spray apparatus shown in FIG. 3 maY also be modified such that the valve means 35 is opened only when the distance from an article is within a predetermined range. It is also possible to modify the spray apparatus so that it can determine the position of the valve member 37 in accordance with any desired signal, irrespective of distance data.

Although the present invention has been describe through specific terms, it should be noted here that the described embodiments are not necessarily limitative, and various changes and modifications may be imparted thereto without departing from the scope of the invention which is limited solely by the appended claims.

What is claimed is:

1. A spray apparatus having a supply passage for a substance which is to be sprayed, a nozzle for jetting out the spray substance, and control valve means provided within said supply passage and adapted to control the flow rate of the spray substance flowing out through said nozzle, wherein the improvement comprises:

distance measuring means integral with said spray apparatus and adapted to measure the distance between said spray apparatus and an article in the direction from said spray apparatus toward the article and output a signal corresponding to the measured distance; and drive means connected to said control valve means and to said distance measuring means for adjusting the degree of opening of said control valve means in response to said output signal.

2. A spray apparatus according to claim 1, wherein said control valve means includes a valve seat provided within said supply passage, and a valve member movable toward and away from said valve seat.

3. A spray apparatus according to claim 2, wherein said drive means includes a motor having an output shaft the rotational position of which is determined in accordance with said output signal, and a transmission mechanism for converting the rotation of said output shaft into the displacement of said valve member.

4. A spray apparatus according to claim 2, wherein said drive means includes a motor having an output shaft the rotational position of which is determined in accordance with said output signal, a solenoid adapted to act such as to move said valve member away from said valve seat, and a stopper connected to said output shaft in such a manner that said stopper is displaced in the longitudinal direction of said output shaft in response to the rotation of said output shaft, said stopper being adapted to determine a valve opening position of said valve member.

5. A spray apparatus having a supply passage for a substance which is to be sprayed, a nozzle for jetting out the spray substance, spray substance control valve means provided within said supply passage and adapted to control the flow rate of the spray substance flowing out through said nozzle, a supply passage for pressurized air, an air nozzle disposed in such a manner that the spray substance flowing out through said nozzle is broken up into a mist by means of the pressurized air jetted out from said air nozzle, and air control valve means provided within said pressurized air supply passage and adapted to control the flow rate of the air jetted out through said air nozzle, wherein the improvement comprises:

distance measuring means provided integral with said spray apparatus in one unit and adapted to measure the distance between said spray apparatus and an article and output a signal corresponding to the measured distance; and drive means adapted to determine the degree of opening of at least one of said spray substance control valve means and said air control valve means on the basis of said output signal.

6. A spray apparatus having a supply passage for a substance which is to be sprayed, a nozzle for jetting out the spray substance, a supply passage to said nozzle, and control valve means for controlling the flow rate of the spray substance flowing out through said nozzle and having a valve seat provided within said supply passage, and a valve member movable toward and away from said valve seat;

distance measuring means integral with said spray apparatus and adapted to measure the distance between said spray apparatus and an article in the direction from said spray apparatus toward the article and generating an output when the measured distance is within a predetermined range; and drive means connected to said control valve means and to said distance measuring means for opening said control valve means in response to said output, said drive means being constituted by a solenoid which when activated moves said valve member in the valve opening direction.

* * * * *